United States Patent [19]

Olkkola

[11] 4,338,718

[45] Jul. 13, 1982

[54] GROUT REMOVING TOOL

[76] Inventor: E. Alfred Olkkola, 24 Wilson Rd., West Yarmouth, Mass. 02673

[21] Appl. No.: 136,167

[22] Filed: Mar. 31, 1980

[51] Int. Cl.[3] ..... B25B 17/00

[52] U.S. Cl. ..... 30/171; 30/172; 30/286; 30/289; 30/294

[58] Field of Search ..... 30/294, 287, 289, 286, 30/299, 172, 171; 279/8, 83; 403/347; 15/236 R, 105.5

[56] References Cited

U.S. PATENT DOCUMENTS

| | | | |
|---|---|---|---|
| 849,681 | 4/1907 | Haurer | 30/172 |
| 1,102,863 | 7/1914 | Bojas | 81/177 D |
| 2,478,026 | 8/1949 | Thorell | 30/299 |

*Primary Examiner*—James L. Jones, Jr.
*Attorney, Agent, or Firm*—Robert R. Churchill

[57] ABSTRACT

The present invention relates to a novel and improved tool for removing worn and cracked grout from between floor, wall and ceiling tiles in a rapid and efficient manner whereby damage to the tiles is reduced to a minimum.

In accordance with one form of the invention novel means is provided for limiting the depth of penetration of the tool in the grout and between the adjacent tiles and in another form of the invention novel means is provided whereby the grout removing portion of the tool may be readily changed to provide a tool adapted for work requiring blade means of different sizes and having different grout removing characteristics.

3 Claims, 11 Drawing Figures

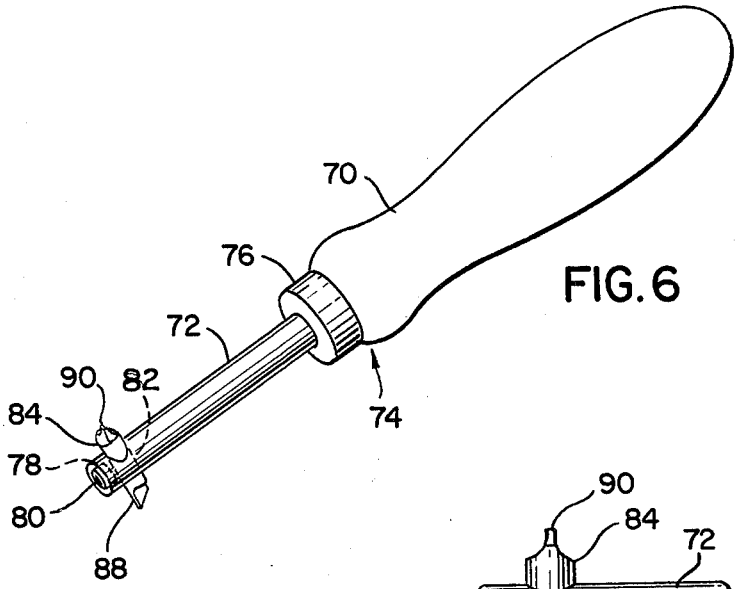
FIG. 6
FIG. 7
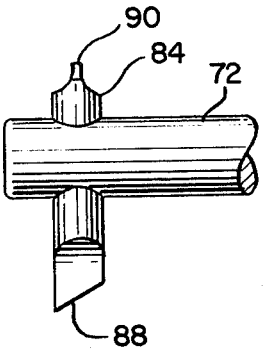
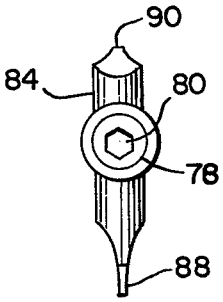
FIG. 8
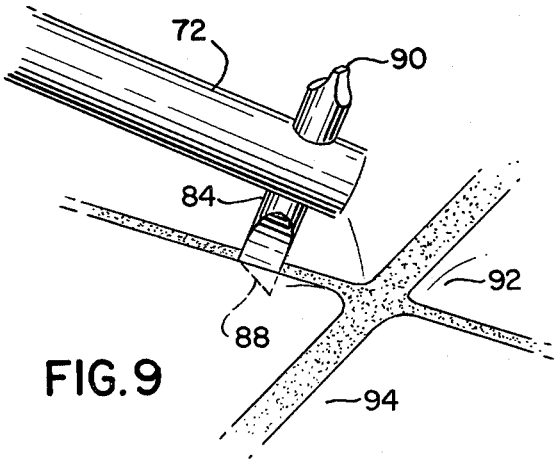
FIG. 9
FIG. 10
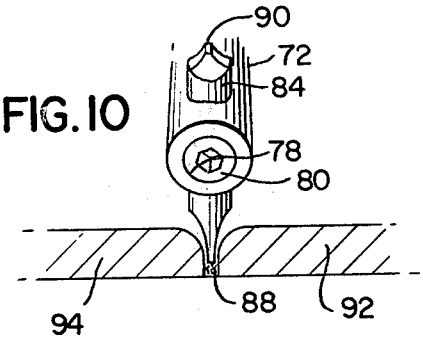
FIG. 11
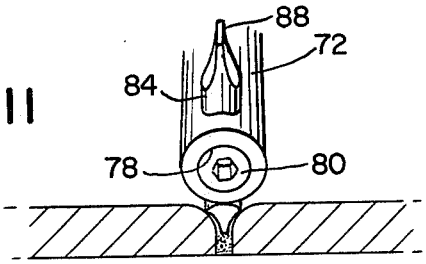

GROUT REMOVING TOOL

BACKGROUND OF THE INVENTION

The invention resides in the field of grout removing tools.

Description of the Prior Art

Prior to the present invention I am unaware of any tools particularly adapted for the removal of grout from between plastic and/or ceramic tiles, i.e., floor, wall and ceiling tiles except such tools as listed hereinafter. Most often used for such work are ordinary screw drivers, and bent over nails. Needless to say clean-cut grout removal is difficult to attain utilizing such tools. In addition to inadequate grout removal use of unsuitable tools such as screw drivers and the like result in a number of instances of cracked or broken tiles and thereby substantial loss of time and money.

Prior art of which I am aware consists of the art disclosed in the following U.S. Pat. Nos.:

| | |
|---|---|
| Redington | 1,488,648 |
| Baelman | 1,826,496 |
| Bashara | 2,359,607 |
| Endicott | 2,496,280 |
| Farchmin | 3,031,704 |
| Gallaglier | 3,155,997 |
| Hartman | 3,688,401 |

Field of the Invention

The present invention has for a principal object to provide a novel and improved grout removing tool characterized by novel and improved structure enabling grout which is cracked or dried out to be removed from between plastic or ceramic tiles on bathroom, kitchen or other walls, ceilings, or floors in a rapid and efficient manner.

A further object of the invention is to provide a tool for removing grout principally from between plastic or ceramic tiles to provide a clean surface for the application of new grout in a rapid and efficient manner wherein breakage of tiles is reduced to a minimum.

A still further object of the present invention is to provide a novel and improved tool having a novel handle and shaft wherein cutting blades may be simply and rapidly changeable wherein different sizes and types of cutting blades are necessary for use for different types of work and which may be used with the same handle.

Another object of the invention is to provide a grout removing tool which is economical to manufacture, and versatile in its uses.

DRAWINGS

In the drawings illustrating the preferred embodiment of the invention:

FIG. 6 is another perspective view showing a modified form of the tool;

FIG. 7 is an enlarged side view of the blade portion of the tool of FIG. 6;

FIG. 8 is a detailed front view of the blade portion of FIG. 7;

FIG. 9 is a side elevation of the blade portion in operation removing grout from between tiles;

FIG. 10 is a front view of the blade of FIG. 9, and

FIG. 11 is an enlarged perspective view of the smaller blade portion in operative position between the tiles.

SUMMARY OF THE INVENTION

Figure 1:
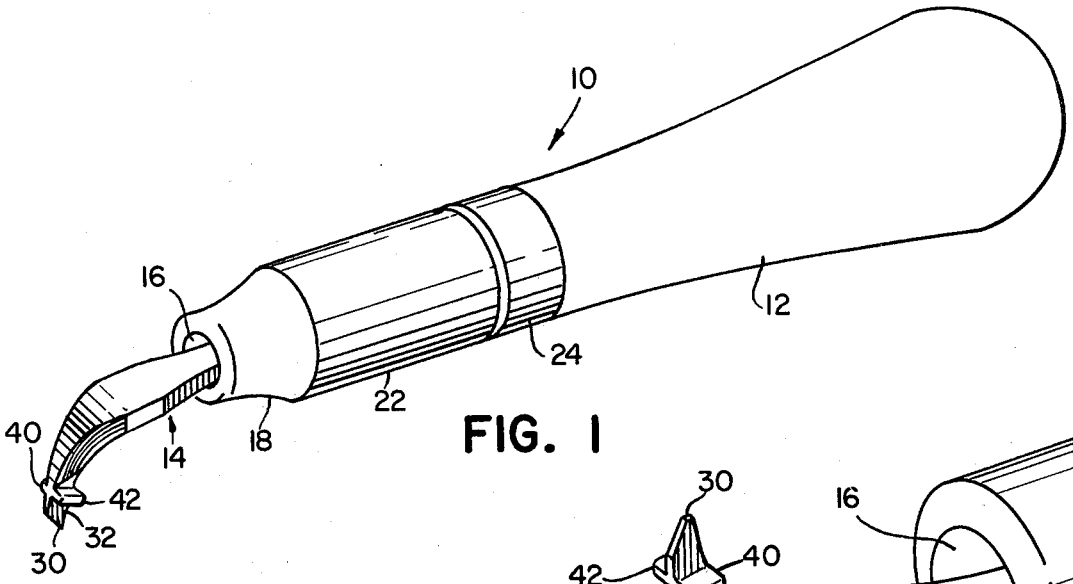
FIG. 1 is a perspective front view of the present tool.

Referring now to the drawings illustrating the preferred embodiment of the present invention, and to FIG. 1 in particular illustrating the present novel and improved grout removing tool. As shown in FIG. 1, 10 illustrates the present tool having an elongated handle 12 and a blade portion 14. The blade portion 14 is attached to the handle 12 by inserting a reduced diameter portion, not fully shown, into a preformed opening 16 in the forward end 18 of the handle 12. In one form of the invention the handle 12 is of wood and the leading end thereof 22 is preferably metal and is secured to the wood portion by means of a metal band 24.

Figure 3:
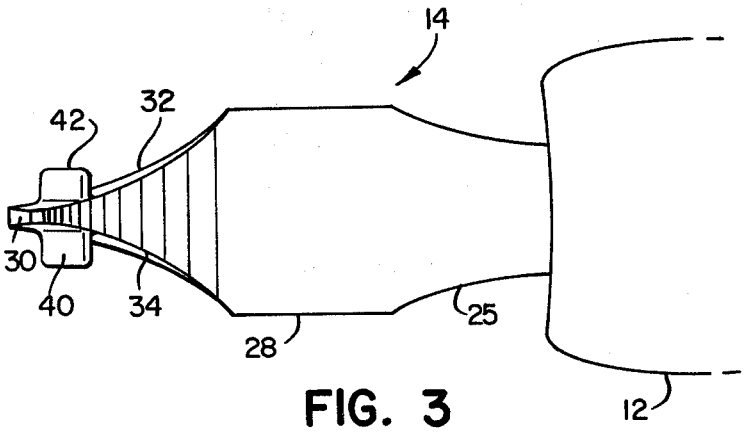
FIG. 3 is a bottom view of the blade portion of the tool.

In another form of the invention, as in FIG. 3, the shank 26 of the blade may be inserted directly into the wooden handle.

Figure 2:
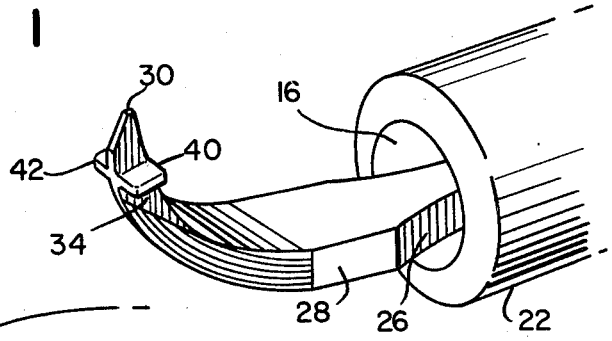
FIG. 2 is an enlarged detailed view of the blade portion of the tool.

FIGS. 2 and 3 are enlarged detail views of the blade portion 14. As shown best in FIG. 2 the blade portion 14 consists of a narrow end 26 inserted into opening 16 in the end of the metal portion 22 of the handle 12, an enlarged portion 28 and a pointed end portion 30. The end portion is beveled on each side as at 32, 34 to thereby provide tapered pointed end portion 30 adapted to be inserted a predetermined depth into the crack 36 between tiles 37, 38 filled with worn or cracked grout. Laterally extended guide flanges 40, 42, one on each side of the narrow end of the blade spaced a short, preferably $\frac{1}{8}''$, distance from the pointed tip 30 of the blade and extending $\frac{1}{8}''$ on each side of the blade are provided for limiting the penetration of the tip of tool as will be hereinafter described.

Figure 4:
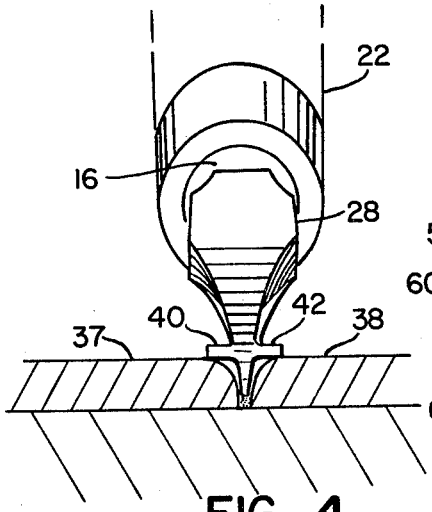
FIG. 4 is a front view of the blade portion of the tool inserted into the crack between the tiles illustrating the operation of the tool in removing the grout.

FIG. 4 illustrates the present tool in operative position within the cracked grout between tiles 37, 38. It will be readily apparent that the pointed end portion 30 of the tool is limited in its penetration into the grout between the tiles 37, 38 by laterally extended flanges 40, 42. This is an important feature of the present tool in that only the desired and correct amount of tile grout is removed during the scrapping operation and damage to the edges of the tiles by the grout remvoing operation is substantially reduced since the penetration of the tool is limited by the flanges which seat themselves on the surface of the adjacent tiles during use of the tool.

The lateral flanges 40, 42 also facilitate speed in use of the tool since little or no thought has to be given to the amount penetration of the blade to avoid breakage of the tiles so prevalent prior to the present invention.

Figure 5:
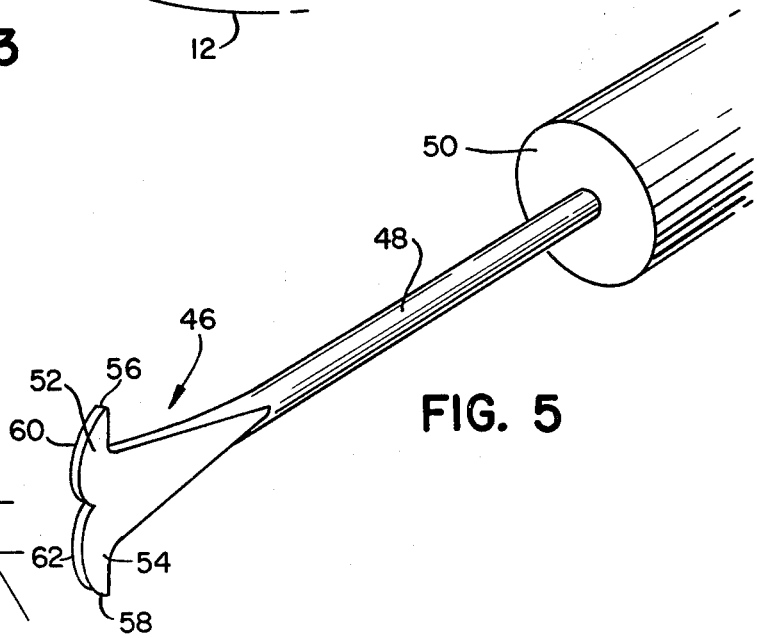
FIG. 5 is a perspective view of a modified form of the tool broken away.

Referring now to FIG. 5, for an illustration and description of a modified form of the present invention. In FIG. 5 the handle, not shown, is similar to that of the forms of the invention shown in FIGS. 1–4. The blade portion 46 consists of an elongated metal shank 48 inserted and secured within the end 50 of the handle, as shown. At the opposite end of the shank member 48 is a two headed cutting blade. Each head 52, 54 of the blade member comprising a sharply pointed end portion 56, 58 and curved edges 60, 62. In use when one of the sharp edges becomes dull due to its abrasion in use while removing grout the tool may be turned over and the remaining sharp blade edge then used to remove the grout from between the tiles also in a rapid and efficient manner.

Another modified form of the present invention is illustrated in FIGS. 6–11. In this form of the invention the novel and improved grout removing tool comprises novel handle and shank members 70, 72. The present handle member 70 is preferably made of a hard wood and is shaped as shown to comfortably fit the hand of the user. The shank member 72 consists of a cylindrical elongated metal member inserted at one end securely into a preformed opening in the end 74 of the handle 70, as shown best in FIG. 6. A metal band 76 is snugly fitted over the narrow end of the handle and assists in retaining the shank in a secure position relative to the handle. A threaded opening 78, shown in dotted lines in FIG. 6 is provided in the free end of shank member 72 and is arranged to carry a set-screw 80. At the end of the opening 78 another opening 82 is formed in the shank member and extends perpendicularly to the said first opening and longitudinal axis of the shank member 72. The opening 82 is adapted to removably carry a cutting member 84 inserted therein. The member 84 is of a diameter so that it fits slidably and snugly in opening 82.

As best shown in FIG. 7, for the purposes of illustration but not by way of limitation, the cutting member 84 consists of a cylindrical member 86 having at one end a reduced diameter portion forming a relatively long sharp tapered cutting edge 88 and at the other end a rather stubby short cutting edge 90. The cutting edges 88, 90 are disposed in planes perpendicular to each other.

In making the present tool ready for use the set-screw 80 is "backed off" leaving opening 82 free and clear to receive the cutting member 84 therein. After member 84 is inserted into the opening the desired proper distance as illustrated in FIGS. 7 and 9 the set-screw 80 is tightened in the usual manner causing the cutting member 84 to be firmly and securely, but removably fixed within the shank 72 of the tool. FIG. 8 shows clearly the set-screw 80 and cutting member in position with the cutting edges 88, 90 positioned the desired distance from the shank member 72 to provide penetration of a predetermined distance into the grout between the tiles. The present novel and improved structure enables the distance of the cutting edges 88 and 90 from shank 72 to be increased or decreased in accordance with the desired penetration into the grout between the tiles by loosening the set-screw and moving the cutting member 84 to a desired position within opening 84 and then retightening the set-screw 80 to secure the member 84 in position.

Referring now to FIGS. 9–11 for illustrations showing the present tool in operation removing worn grout from between tiles 92, 94. In FIGS. 9 and 10 the larger cutting edge 88 is arranged to do the grout removing operation and it is shown inserted between the tiles. FIG. 11 illustrates a grout removing operation wherein the shorter different cutting edge 90 is required. The cutting edge 90 is inserted between the tiles and into the worn grout.

In accordance with the present invention in order to remove worn grout from between adjacent tiles the cutting member is easily adjusted so that the particular cutting edge is selected. Then the set-screw may be loosened and the cutting member 84 moved within opening 80 to its desired position relative to the shank number 72. Thus not only the type of cutting edge, but also its length and consequently grout penetration may be rapidly attained. When the member 84 is in its desired position it is easily secured therein by simply tightening set-screw 80. The cutting edge 88 is then inserted into the grout between adjacent tiles and with pressure exerted on the tool it is drawn along the grout line removing grout in its path.

After the tiles are cleaned of the old worn and cracked grout as hereintofore described new grout may be troweled in between the tiles in the usual manner.

While as illustrated and described the tool of FIGS. 9–11 embodies the cutting members therein shown, it will be understood that other cutting members may be interchangeably used therewith without departing from the scope of the present invention.

One of the most important and novel features of the present form of the invention shown and described in connection with the tool of FIGS. 9–11 resides in the fact that the novel structure of handle and shank enables cutting members having different cutting configurations and sizes to be interchangeably used so well as adjusted within the shank in a rapid and efficient manner.

From the foregoing description of the present novel and improved grouting removing tool and its several modifications it will be apparent that the invention provides a tool which not only is capable of being economically manufactured but also is high efficient in use in removing cracked and worn grout from between adjacent tiles and plastic or ceramic tiles in particular wherein tile breakage is reduced to a minimum.

Having thus described the present invention, what is claimed is:

1. A grout removing tool for removing cracked and worn grout from between tiles comprising a handle having an elongated one piece shaft secured thereto and a single grout cutting blade member removeably and adjustably secured within and adjacent to the end of the shaft, said blade member having an elongated and tapered cutting edge on one end thereof and a short stubby tapered cutting edge on the opposed end of the said blade member.

2. A grout removing tool of the character described in claim 1 wherein the longitudinal axis of the cutting edge on one end of the blade member lies in a plane perpendicular to the axis of the cutting edge on the other end of the blade member.

3. A grout removing tool as defined in claim 2, wherein the elongated shaft is cylindrical, and wherein the blade member is retained within the one piece shaft in a position perpendicular to the longitudinal axis of the shaft.

* * * * *